US010259618B2

(12) United States Patent
Gonzalez Valencia

(10) Patent No.: US 10,259,618 B2
(45) Date of Patent: Apr. 16, 2019

(54) CLOSING SYSTEM FOR BOTTLES AND SMALL BOTTLES AND METHOD FOR THE USE THEREOF FOR THE OPENING OF SAID BOTTLES

(71) Applicant: TAPOINTEL S.L., A Coruna (ES)

(72) Inventor: Juan Gonzalez Valencia, Valencia (ES)

(73) Assignee: TAPOINTEL S.L., A Coruna (ES)

( * ) Notice: Subject to any disclaimer, the term of this patent is extended or adjusted under 35 U.S.C. 154(b) by 0 days.

(21) Appl. No.: 15/512,128

(22) PCT Filed: Feb. 19, 2016

(86) PCT No.: PCT/ES2016/000029
§ 371 (c)(1),
(2) Date: Mar. 17, 2017

(87) PCT Pub. No.: WO2016/131997
PCT Pub. Date: Aug. 25, 2016

(65) Prior Publication Data

US 2017/0361995 A1 Dec. 21, 2017

(30) Foreign Application Priority Data

Feb. 20, 2015 (ES) ..... 201500154

(51) Int. Cl.
*B65D 41/04* (2006.01)
*B65D 39/12* (2006.01)
(Continued)

(52) U.S. Cl.
CPC ..... *B65D 41/0414* (2013.01); *B65D 39/12* (2013.01); *B65D 41/10* (2013.01);
(Continued)

(58) Field of Classification Search
CPC .... B65D 41/0414; B65D 41/17; B65D 41/10; B65D 41/18; B65D 39/12; B65D 2539/001
(Continued)

(56) References Cited

U.S. PATENT DOCUMENTS 221,874 A 11/1879 Sponsler
4,401,228 A * 8/1983 Baldelli ..... B65D 39/12 215/360
4,632,282 A * 12/1986 Nagashima ..... B65D 47/122 220/270

FOREIGN PATENT DOCUMENTS

DE 19630729 2/1998
EP 1300342 A1 4/2003
(Continued)

OTHER PUBLICATIONS

International Search Report, PCT/ES2016/000029, dated May 31, 2016.

*Primary Examiner* — James N Smalley
(74) *Attorney, Agent, or Firm* — Porzio Bromberg & Newman P.C.

(57) ABSTRACT

Closing system for bottles and small bottles and method for the use thereof for the opening of said bottles integrated by a single piece with three differentiated parts, two of them, inner threaded hole and screw (7), made of rigid material and joined by a pre-cut line, used as a base on which an elastic part (10) is overpressed. This elastic part (10) has some perimeter grooves (18) that, when fastening the screw (11) in the inner threaded hole (4) of the neck (3), presses the elastic part (10) and secures it against the walls of the bottleneck (3). The bottle can be opened by just lifting the covering half fins (9) and turning them in the opposite direction to the thread, so the elastic part (10) is decom-
(Continued)

pressed and can be easily removed, leaving the bottle opened. All materials are food grade materials.

2 Claims, 4 Drawing Sheets

(51) Int. Cl.
*B65D 41/10* (2006.01)
*B65D 41/17* (2006.01)
*B65D 41/18* (2006.01)

(52) U.S. Cl.
CPC ..... *B65D 41/17* (2013.01); *B65D 41/18* (2013.01); *B65D 2539/001* (2013.01); *B65D 2539/005* (2013.01)

(58) Field of Classification Search
USPC ..... 215/360, 305, 302; 220/235
See application file for complete search history.

(56) References Cited

FOREIGN PATENT DOCUMENTS

| | | |
|---|---|---|
| ES | 2284403 | 11/2007 |
| GB | 261340 | 10/1927 |
| GB | 587289 | 4/1947 |

* cited by examiner

CLOSING SYSTEM FOR BOTTLES AND SMALL BOTTLES AND METHOD FOR THE USE THEREOF FOR THE OPENING OF SAID BOTTLES

PURPOSE OF THE INVENTION

The invention included in the scope of this application and the design brief consists of a closing system for bottles and small bottles and method for the use thereof for the opening of said bottles as the title indicates.

Mastering this technique and the industrial application scope are included in the large and small bottle sector for health and food products, both for glass and plastic bottles.

The recommended use of the cap described below is for single-use bottles containing carbonated liquids.

BACKGROUND OF THE INVENTION

According to the state of the art analysis, no other product has identical or similar features.

Thus, the purpose of the invention offers key advantages for its application, not covered by other similar or alternative means.

The 'closing system for bottles and small bottles and method for the use thereof for the opening of said bottles' is a single-use, easy-open system completely different from any other known easy-open cap system, as it does not require any rings or threads inside or outside the bottle opening.

In this particular case, the 'closing system for bottles and small bottles and method for the use thereof for the opening of said bottles' does not require any type of tool to open the bottle, such as corkscrews or bottle openers. The bottle can be opened directly by hand and just with a very small effort.

Moreover, following the necessary technical tests completed, the system offers a level of permissibility and tightness higher than the traditional systems known, such as crown cork caps or cork caps. Although these systems are not easy-open, they are indeed used for capping and closing.

Made using plastic materials of food grade, it closes the bottle by applying a pressure on the walls of the bottleneck and is also supported by the tapered shape given to this part of the bottle to facilitate the closing, so the higher the inner pressure, the more effectively the system closes.

According to the inventor, expert in this area, the purpose of the invention constitutes an important innovation that, due to its qualities and advantages, has an evident industrial and commercial interest.

DESCRIPTION OF THE INVENTION

The closing system for large and small bottles is basically integrated by a piece with three parts, two of them made of the same rigid plastic material and the third, elastic one overpressed on them.

This piece is inserted though the bottleneck, with one of the rigid parts acting as a threaded hole (the part covering) and the other as a screw (the part closing). Both parts are joined by a section of very thin material.

When the screw part begins to be fastened to the threaded hole, such joint is broken, allowing the screw and cover to be completely fastened.

The clearance between the screw head and the cover gets reduced when they are screwed together, pressing the elastic part against the walls of the bottleneck, thus closing the bottle.

The elastic part is attached to the walls of the bottleneck by the action of the vacuum created in the grooves of this elastic part. The air contained in such grooves is suctioned when the elastic part presses against the walls of the bottleneck and this creates the vacuum effect that secures the piece.

Finally, the mordant and anti-sliding of the elastic part on the glass helps securing the cap or multi-part piece, closing the bottle.

The opening can be achieved by turning in the opposite direction to the thread because such action decompresses the elastic part, as the air re-enters its grooves.

Moreover, the invention is intended to be convenient and easy to use, and similarly, its removal or disposal is also easy and convenient, without harming the environment.

To complement the description below and in order to help better understand the features of the invention, the following design brief includes four drawing sheets to facilitate understanding the innovations and advantages of the device included in this invention.

BRIEF DESCRIPTION OF THE DRAWINGS

In order to understand the scope of the features and advantages of the purpose of the invention, the object, application and brief include six drawings that complement the description of a preferred execution mode that will be carried out next, the content of which is not limiting but merely illustrative.

FIG. 1—
(1) COVER
(2) NARROWING OF THE MATERIAL
(3) NECK
(4) INNER THREADED HOLE
(5) LIP
(6) INVERTED TAPERED SECTION
(7) JOINT OF INNER THREADED HOLE AND SCREW
FIG. 2—
(8) DRIVE SHAPE
(9) COVERING HALF FINS
FIG. 3—
(10) ELASTIC PART
(11) SCREW
(12) ELASTIC PART GROOVES WITH SUCTION EFFECT
(13) SCREW HEAD
FIG. 4—
(14) SCREW THREAD
(15) CLAMPING LINE
(16) FASTENING RING
FIG. 5—
(9) COVERING HALF FINS

FIG. 6—
(17) UNSCREWING CLEARANCE
(18) PERIMETER GROOVES

DESCRIPTION OF A PREFERRED EXECUTION MODE

Figure 1:
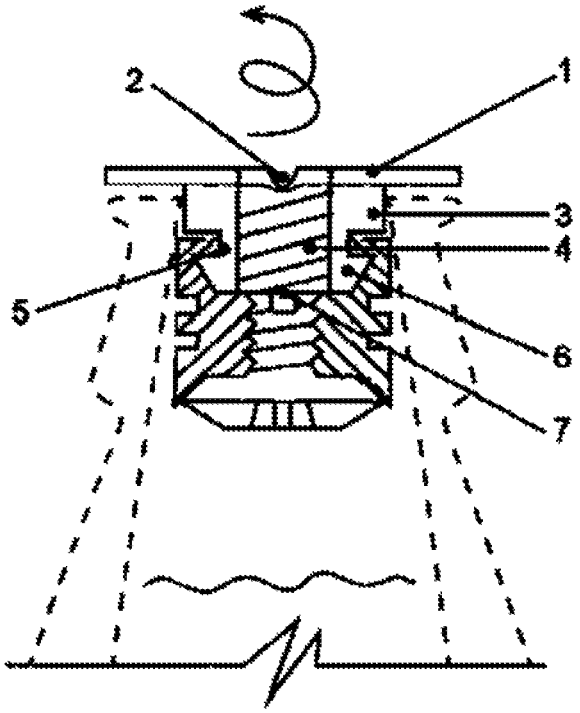
FIG. 1.—shows a cross-section of the piece with its different parts.

FIG. 1. The cover (1) has a narrowing of the material (2) that will act as a hinge, pivoting over the neck (3) that has an inner threaded hole (4) inside.

On the outer cylindrical surface of the neck (3) a lip (5) can be noticed that acts as a groove. Said neck (3) ends in an inverted tapered shape (8).

This part of the closing system piece shows a kind of circular section, joining the inner threaded hole and the screw, and it is very thin, so it can be cut, releasing both parts, cover and screw, in order to fasten them together. This break occurs when the fastening starts.

Figure 2:
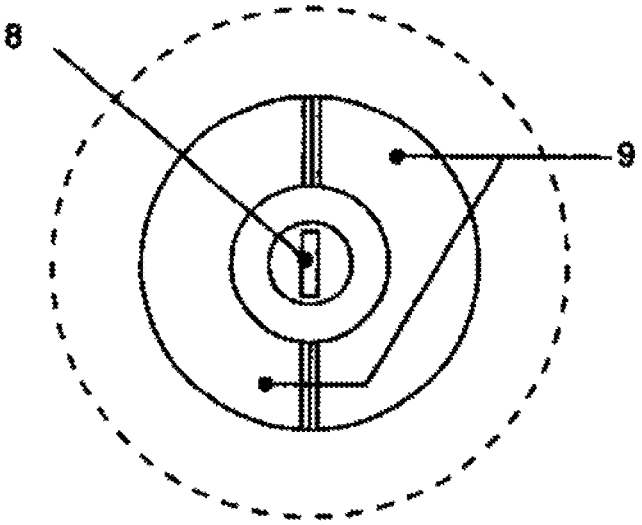
FIG. 2.—shows a plan view of the piece

FIG. 2. The fastening is completed using a flat head screw driver or similar tool, introduced into the drive shape (8) in an inverted position, that is, with the head below, holding the covering half fins (9) in their position.

Figure 3:
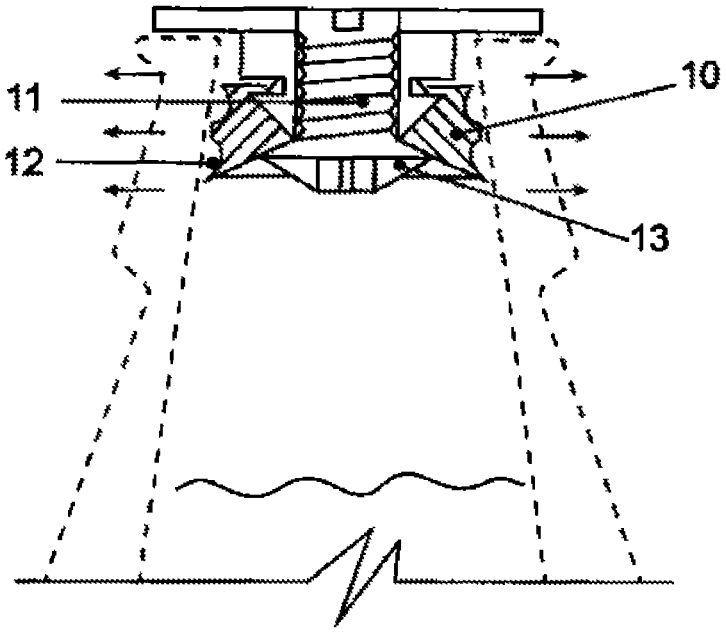
FIG. 3.—shows the screw part screwed in the threaded hole part and pressing the elastic part. The figure also includes a cross-section of the set.

FIG. 3. When fastening the screw into the inner threaded hole, the elastic part (10) is compressed and stays like this.

When this occurs, the grooves with suction effect (12) attach this part to the walls of the bottleneck. The element pressing the screw (11) against the inner threaded hole (4) is the screw head (13) with a tapered shape and this facilitates pushing out the elastic part (10) towards the bottleneck.

Figure 4:
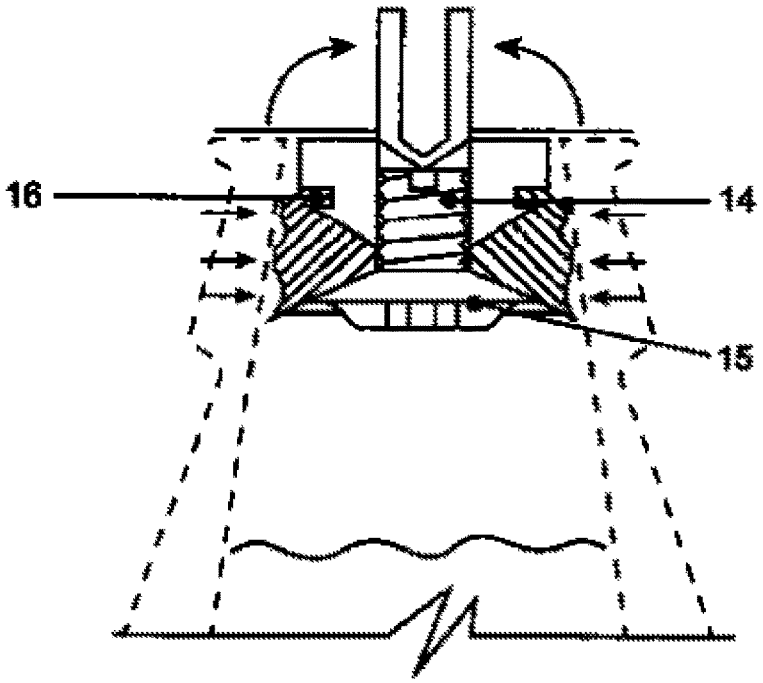
FIG. 4.—shows a cross-section of the screw part fastened to the threaded hole part pressing the elastic part and the covering half fins already lifted to facilitate unfastening the screw and opening the bottle.

FIG. 4. The screw thread (14) matches that of the inner threaded whole (4) and the clamping line (15) of the screw head (13) so it allows choking and securing the compressed elastic part (10) to stop the pressure of the liquid contained from opening the bottle. The elastic part (10) is secured against the neck (3) by the fastening ring (18) of the elastic part (10) inserted into the lip (5).

Figure 5:
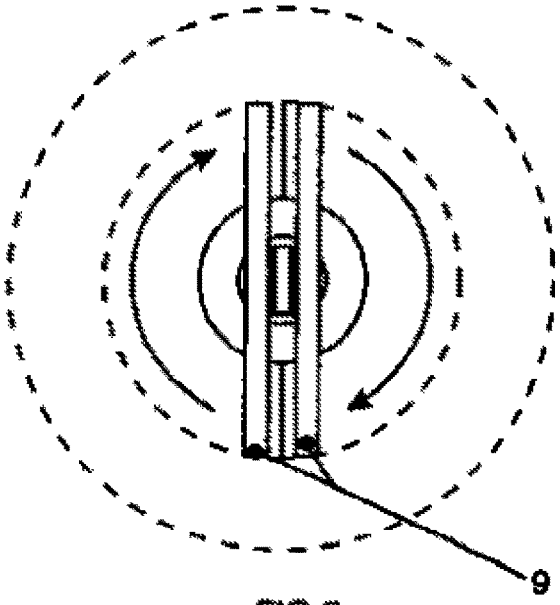
FIG. 5.—shows a plan view of the piece with the covering half fins lifted.

FIG. 5. To unscrew the piece and open the bottle, the covering half fins (9) must be lifted, so the thumb and index fingers can hold them and turn them in the opposite direction of the thread, opening the bottle.

Figure 6:
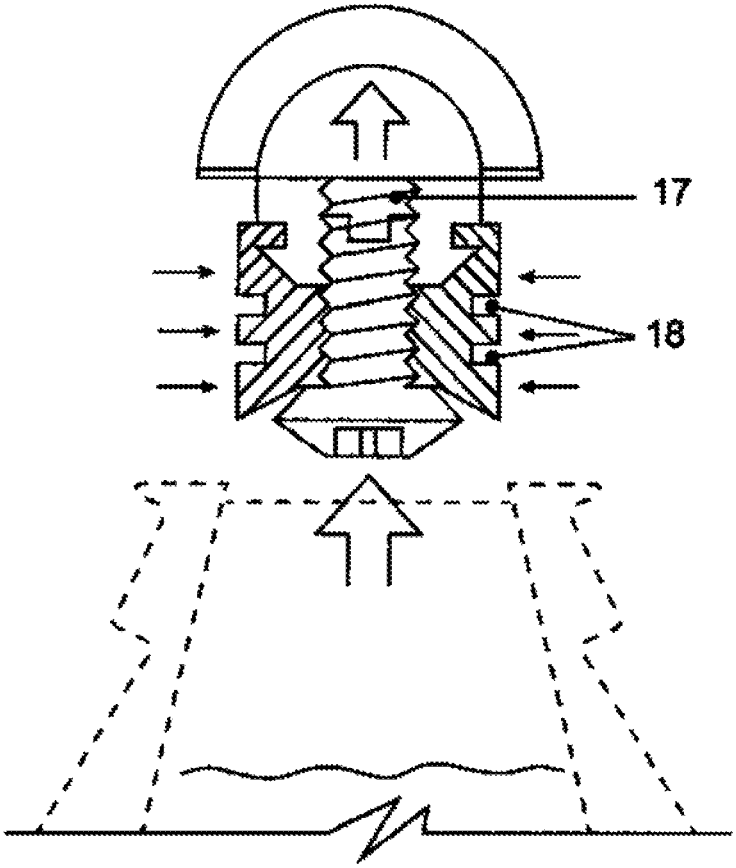
FIG. 6.—shows the cap piece already extracted from the bottle and it shows a cross-section of the screw partially unscrewed and the decompressed elastic part.

FIG. 6. When the cap has been released, there will be an unscrewing clearance (17) that allows decompressing the elastic part (10), so the perimeter grooves (18) have no pressure and the part recovers the original diameter. Then, it can be removed from the bottle.

The invention claimed is:

1. A closing system for large and small bottles comprising a single piece that acts as a cap or closing, integrated by three parts: a cover, a screw and an elastic part, the cover and the screw are made of a rigid material and the elastic part is overpressed on the cover and the screw; the piece is manufactured using a food grade material:

the cover covers an opening of the bottle, the cover has a narrowing of material at one of the diameters defining covering half fins, the covering half fins starting at a top of the cover and stem out from a neck that enters an opening of the bottle, inside the neck is an inner threaded hole and outside the neck is a lip that acts as a circular groove, the neck ends with an inverted tapered shape, an interior of the inner threaded hole is joined to the screw in an inverted position by a fine strip of material, to form a joint, the joint between the inner threaded hole and the screw will break when the screw is fastened inside the inner threaded hole of the neck:

a drive shape on a head of the screw allows using a tool to fasten the screw to the inner threaded hole the head of the screw has a clamping line on the elastic part, the elastic part is overpressed on the cover and the screw from the lip to the clamping line, the elastic part has perimeter grooves so when the threaded part of the screw is inserted into the inner threaded hole in the neck, the elastic part is compressed and the screw attaches to the lip of the neck by the fastening ring which opens the perimeter grooves of the elastic part with a suction effect and the piece is attached to the walls of the neck of the bottle.

2. A method for opening the closing system for large and small bottles as described in claim 1 comprising the steps of: first, the covering half fins are folded so they lift up; second, the covering half fins are turned by hand in the opposite direction to the thread to decompress the elastic part so an unscrewing clearance is left; third, the piece is pulled up and the large or small bottle is opened.

* * * * *